US007038631B2

(12) United States Patent
Jecko et al.

(10) Patent No.: US 7,038,631 B2
(45) Date of Patent: May 2, 2006

(54) MULTI-FREQUENCY WIRE-PLATE ANTENNA

(75) Inventors: Bernard Jean Yves Jecko, Rilhac Rancon (FR); Mohamed Hammoudi, Limoges (FR)

(73) Assignee: Centre National de le Recherche Scientifique (CNRS), Paris (FR)

( * ) Notice: Subject to any disclaimer, the term of this patent is extended or adjusted under 35 U.S.C. 154(b) by 0 days.

(21) Appl. No.: 10/481,122

(22) PCT Filed: Jun. 18, 2002

(86) PCT No.: PCT/FR02/02090

§ 371 (c)(1),
(2), (4) Date: Dec. 18, 2003

(87) PCT Pub. No.: WO02/103843

PCT Pub. Date: Dec. 27, 2002

(65) Prior Publication Data

US 2004/0164916 A1 Aug. 26, 2004

(30) Foreign Application Priority Data

Jun. 18, 2002 (FR) ..... 01 07940

(51) Int. Cl.
*H01Q 13/10* (2006.01)

(52) U.S. Cl. ..... 343/767; 343/702; 343/846

(58) Field of Classification Search ..... 343/702, 343/767, 770, 846, 848, 700 MS
See application file for complete search history.

(56) References Cited

U.S. PATENT DOCUMENTS

| | | | | |
|---|---|---|---|---|
| 4,771,291 | A | 9/1988 | Lo et al. | 343/700 MS |
| 6,014,105 | A | 1/2000 | Davis et al. | 343/700 MS |
| 6,133,879 | A | 10/2000 | Grangeat et al. | 343/700 MS |

(Continued)

FOREIGN PATENT DOCUMENTS

WO WO 00/36700 6/2000

OTHER PUBLICATIONS

Viratelle, D. et al, "Dual-band printed Antenna for mobile telephone applications," IEE Proceedings H. Microwaves, Antennas & Propagation, Institution of Electrical Engineers, Stevenage, GB, vol. 147, No. 5, Oct. 10, 2000, pp. 381-384.

(Continued)

*Primary Examiner*—Hoang V. Nguyen
(74) *Attorney, Agent, or Firm*—Steptoe & Johnson LLP

(57) ABSTRACT

The invention relates to an antenna comprising: a first electroconductive surface; a second electroconductive surface which forms a ground plane and is parallel to the first; a first electroconductive feed belt or wire connecting a first terminal of a generator/receiver to the first surface, the second surface being connected to the second terminal of the generator/receiver, and at least one second electroconductive wire or ribbon connecting said two surfaces. The antenna is characterized in that the first surface comprises a blank, or a series of blanks, each blank optionally consisting of mutually extending sections. Said blank(s) extend in the vicinity of and along part of the edge of the first surface 2 which is broad enough for the blank(s) to define an inner area of the first surface by substantially forming a majority of the periphery of this area, thereby obtaining a multi-frequency wire-plate operation.

22 Claims, 6 Drawing Sheets

U.S. PATENT DOCUMENTS

| | | | | |
|---|---|---|---|---|
| 6,195,048 | B1 | 2/2001 | Chiba et al. | 343/700 MS |
| 6,348,892 | B1 * | 2/2002 | Annamaa et al. | 343/700 MS |
| 6,529,168 | B1 * | 3/2003 | Mikkola et al. | 343/702 |
| 6,624,788 | B1 * | 9/2003 | Boyle | 343/702 |
| 6,646,610 | B1 * | 11/2003 | Troelsen | 343/702 |
| 6,759,991 | B1 * | 7/2004 | Boyle | 343/702 |
| 2002/0003499 | A1 | 1/2002 | Ngounou | |

OTHER PUBLICATIONS

Rosa, J. et al, "Dual-band microstrip patch antenna element wit double U slots for GSM," IEEE Antennas and Propagation Society Internationa Symposium, 2000 Digest, Aps. Salt Lake City, UT, Jul. 16-21, 20000, New York, NY, vol. 3 of 4, Jul. 16, 2000, pp. 1596-1599.

Zurcher, J, et al, "Broadband patch antennas," Broadband Patch Antennas, The Artech House Antenna Library, Boston, MA, Artech House, 1995, Figure 2.

* cited by examiner

MULTI-FREQUENCY WIRE-PLATE ANTENNA

This application is a 371 of PCT/FR02/02090 dated 18 Jun. 2002.

The invention relates to the field of antennas, and more specifically the field of wire-plate antennas.

Wire-plate antennas are known that consist, as represented in FIG. 1, of a metal plate 120 (capacitive top part of the antenna) having, in principle, arbitrary shape, of a dielectric layer 130 bearing this plate on its upper face and of a ground plane 140 produced by lower metallization of the dielectric layer.

The feed for such an antenna is typically realized by a coaxial line 150 which passes through the ground plane 140, an inner conductor 152 of which is connected to the metal top part 120 and an outer conductor 154 of which is connected to the ground plane 140. The particular aspect of such an antenna is that of having a wire 160 connecting the capacitive top part 120 and the ground plane 140, forming an active metal return to ground.

The return-to-ground wire 160 gives rise to a "parallel" resonance at a frequency less than that of a "fundamental" frequency of a patch.

This parallel resonance is due to an exchange of energy between the self inductance L and the capacitance C of a resonator formed by the return-to-ground wire (inductive effect λ) and the capacitive top part.

A resonant frequency is then obtained, thus giving a range of matching of the antenna, of the type:

$$\frac{1}{2\pi\sqrt{LC}}$$

The physical parameters affecting this frequency are the permittivity of the dielectric substrate $\epsilon_r$, its height (distance between the top part and the ground plane), the radius of the feed line 150, the radius of the return-to-ground wire 140, the distance between the feed line 150 and the return-to-ground wire 160, and the dimensions of the top part 120 and of the ground plane 140.

This large number of parameters multiplies by as much the number of possible configurations, enabling the antennas to be optimized to meet performance specifications.

The wire-plate antenna radiation arises mainly from the return wires 160 and exhibits the typical characteristics of radiation from a monopole perpendicular to the ground plane, the characteristic radiation being an omnidirectional azimuth radiation with respect to the ground plane and almost zero perpendicular to this plane.

Thus, such an antenna exhibits a radiation pattern having a lobe with rotational symmetry, with maximum radiation directed approximately parallel to the ground plane and a minimum radiation in the axis of the feed and return wires. In accordance with the typical radiation of a monopole perpendicular to the ground plane. It is to be noted that in the case of finite ground planes, the effects of diffraction through the breaks in the ground plane 140 introduce distortions of the radiation pattern and a backward radiation.

The operation of a wire-plate antenna is therefore very different from the operation of another type of antenna known as a "resonant antenna". This is because, the resonance referred to for these "resonant antennas" is an electromagnetic type resonance (resonant modes) and not an electric type resonance as is the case for wire-plate antennas.

This is because, in wire-plate antennas, the resonant elements are localized, similar to electrical components.

Operation by electrical resonance and the use of structures like electrical components results in wire-plate antennas having a dimension much smaller than the wavelength, and in any case having dimensions smaller than the smallest dimensions of "resonant antennas".

The operation of wire-plate antennas is therefore very different from electromagnetic resonance operation that governs the antennas referred to as "resonant antennas".

The operation of wire-plate antennas distinguishes them in particular from "microstrip" or "microslot" antennas known to those skilled in the art.

Despite the existence of many possibilities in choosing physical parameters to best adapt the known antenna to performance specifications, in practise it is desirable to have an antenna that is still more easily configurable, at its construction stage, in accordance with the multiband, multifunction behavior desired.

This aim is achieved according to the invention by virtue of an antenna of the type comprising:

- a first electrically-conductive surface;
- a second electrically-conductive surface, forming a ground plane, parallel to the first surface;
- a first electrically-conductive feed wire or strip connecting a first terminal of a generator/receiver to the first surface;
- the second surface being connected to a second terminal of the generator/receiver; and
- at least one second electrically-conductive wire or strip connecting the two abovementioned surfaces, characterized in that the first surface has a cutout-slot, or a series of cutout-slots, each cutout-slot being formed, possibly, of mutually extending sections, this (or these) cutout-slot(s) stretching to near and along an edge part of this first surface, this edge part being sufficiently extensive in order that the cutout-slot(s) defines an inner region of the first surface by substantially forming most of the periphery of this region, thereby achieving a multi-frequency wire-plate operation.

These cutout-slots generate different capacitances leading to different resonant frequencies of the wire-plate antenna in accordance with the previously mentioned formula.

Preserving the wire-plate radiation (that is to say omnidirectional azimuth) also distinguishes this antenna from those encountered in literature for which antennas it is the cutout-slot in the surface that radiates with a maximum in the axis perpendicular to this surface and not a very weak radiation in this direction as is the case for a wire-plate antenna and especially in the invention.

Advantageously, the first surface has a cutout-slot of very small width with respect to its length and to the main wavelength picked up (preferably a tenth of this length). There may be several cutout-slots, for example greater than two in number.

According to advantageous but non-limiting arrangements:

- the cutout-slot(s) of the first surface has (have) very small widths in comparison with its (their) length and with the operating wavelengths;
- said at least one second electrically-conductive wire or strip connecting the first and second surfaces makes contact with the first surface inside said region, and preferably in the middle of the antenna, which region is surrounded mostly by the cutout-slot(s);

said first electrically-conductive feed wire or strip connecting a first terminal of a generator/receiver to the first surface makes contact with this first surface inside said region which is mostly surrounded by the cutout-slot(s);

the first and second surfaces are arranged one facing the other and in parallel with each other, in that the first and second electrically-conductive wires or strips extend one parallel with the other and perpendicularly to the planes of the two surfaces, and in that the cutout-slot or series of cutout-slots forms two designs that are perfectly symmetrical with respect to a geometric plane passing through these two conductive wires or strips;

the first surface has a cutout-slot formed of two sections each having the shape of a C, with one open part of the C-shape facing the other;

the two sections are symmetrical with each other with respect to a first geometric plane passing between these two sections and in that each section is symmetrical with itself with respect to a second geometric plane passing through the centers of these two cutout-slots;

the first surface has at least two cutout-slots each having respective shapes that are sufficiently similar in order that these two cutout-slots generate two peaks of electromagnetic effectiveness on the wire-plate mode, mixed at the same frequency;

the first surface has at least two cutout-slots and in that these two cutout-slots have respective shapes that are sufficiently similar such that these two cutout-slots generate two electromagnetic effective-operation peaks on the wire-plate mode, which overlap frequencywise, thus forming a widened effective operating in frequency band;

the first surface has at least two cutout-slots having sufficiently different shapes in order that these cutout-slots generate at least two effective operating frequency regions, on the wire-plate mode, of the antenna which do not overlap one another;

the first surface is defined by any type of shape, and in that the cutout-slot or cutout-slots remain parallel to the edge of this shape;

one of the surfaces forming the ground plane includes one or more cutout-slots of the same type as for the first surface;

the surfaces are substantially identical and the same operation is observed due to the fact that the cutout-slots are present in the ground plane;

the ground plane is markedly larger than the first surface, the frequencies generated being the same, but the radiation patterns being different, due to the presence of the ground plane;

it includes one or more dielectric or magnetic layers between the surface forming the ground plane and the first surface and also above the two surfaces (radome);

the antenna comprises superposed top parts and intermediate planes, the cutout-slots being made in any intermediate plane, and dielectric or magnetic materials being interposed for rigidity or tunability or miniaturization.

Other features, aims and advantages of the invention will become apparent from reading the detailed description that follows, made with reference to the accompanying figures in which.

Figure 1:
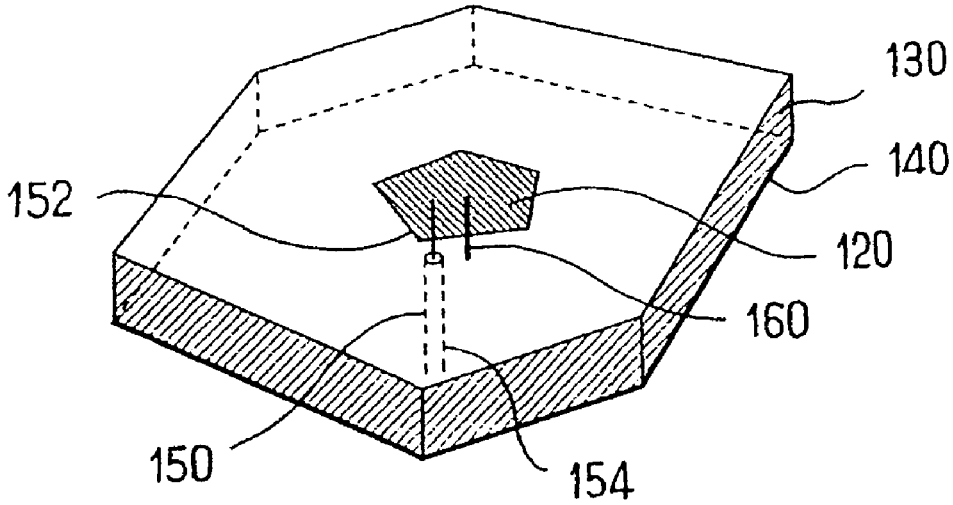
FIG. 1 is a perspective view of an antenna of known type.
Figure 2:
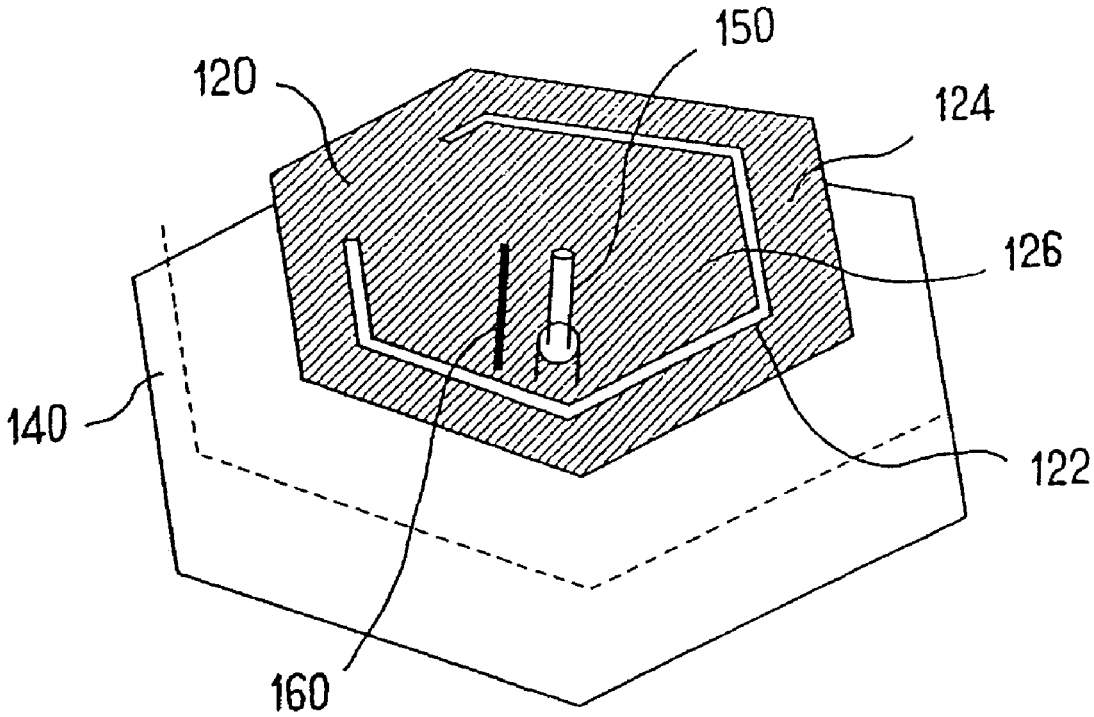
FIG. 2 is a perspective view of an antenna according to a first embodiment of the invention.
Figure 11:
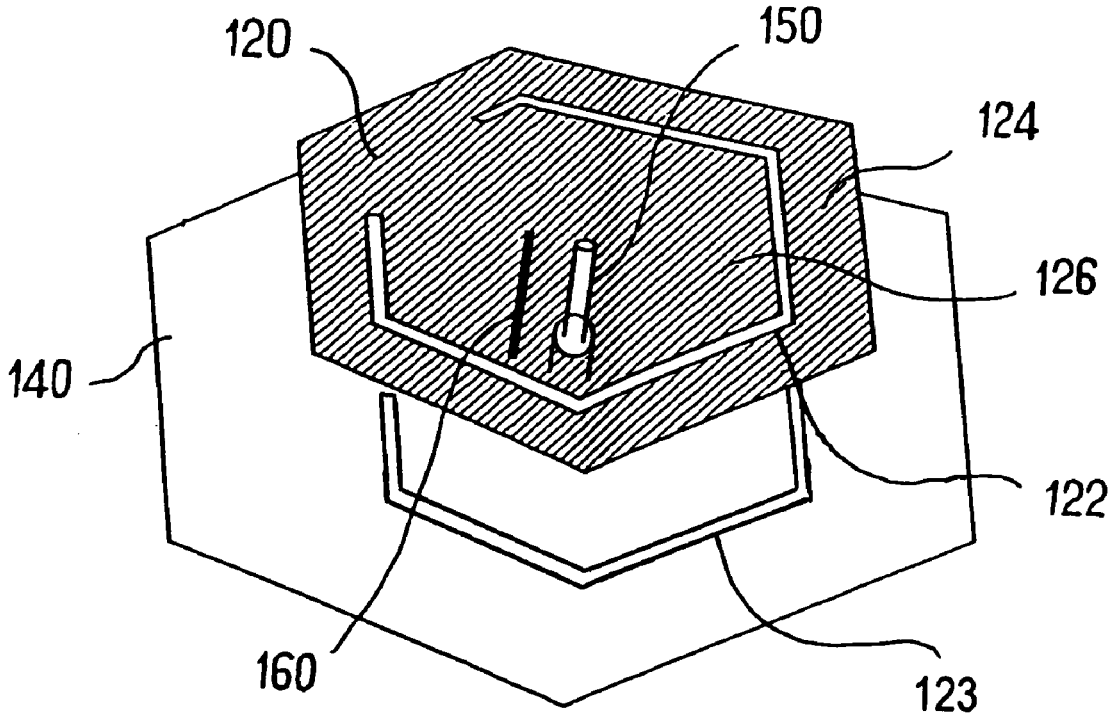
FIG. 11 is a perspective view of the antenna according to another embodiment of the invention.

The antenna of FIG. 2 and FIG. 11 adopts the main elements of the known antenna of FIG. 1.

It has a top part 120 that is defined by a series of rectilinear segments of any shape (polyhedron, circular, etc.).

However, in this case, the capacitive top part 120 has a cutout-slot 122 that extends along the edges of this capacitive top part, thus forming a boundary between an edge region 124 of the top part and a central region 126 of the top part 120.

This cutout-slot is of a form that comes back round on itself, but is interrupted on a short stretch of the edge of the top part, such that it describes the general shape of a C. More specifically, the C that it describes is made up of a series of rectilinear portions, each parallel to a corresponding rectilinear edge of the capacitive top part, and the cutout-slot must not be closed up in order to keep a strip of metal exciting the outer antenna.

The antenna has a ground wire 160 and a feed line 150 that extend transversely to the antenna, and that make contact with the top part 120 at its part that is enclosed by the C-shape cutout-slot.

Adopting such a cutout-slot or slot 122 generates two capacitive effects: one at the top part edge 124 (outer part of the slot), and the other at the inner part 126 of the top part.

The addition of such a cutout-slot 122 typically creates an additional resonance of the antenna at a neighboring wavelength of $\lambda_f/2$, where $\lambda_f$ corresponds to the total length of the slot.

Thus, the present antenna generates two resonances: one at the wavelength $\lambda$ corresponding to that of the wire-plate antenna having the region 126 inside the cutout-slot 122 as the capacitive top part, and the other resonance being at a smaller wavelength $\lambda_f/2$ generated by the presence of the cutout-slot 122.

This antenna exhibits a wire-plate type radiation at these two resonant frequencies.

More specifically, the presence of the cutout-slot 122 introduces new physical parameters that affect the electromagnetic behavior, that is to say the width of the cutout-slot 122 measured parallel to the plane of the capacitive top part and transversely to the cutout-slot 122, the position of the cutout-slot 122 on the top part, the position of the cutout-slot 122 with respect to the feed wire 150 and with respect to the return wire 160, and the length of the cutout-slot.

These physical parameters then supplement the physical parameters that normally affect the behavior of antennas, and multiply the number of possible configurations of the antenna enabling the antenna to be better adapted to the use envisaged, in particular by the dual resonance.

As will be seen later, the slot resonates (enabling the antenna to be matched) but does not radiate significantly since the radiation remains that of a wire-plate.

In the embodiment of FIG. 11, the ground plane (140) includes a cutout-slot (123) of the same type as the first surface (120). The first and second surfaces (120) and (140) are substantially identical such that the cutout-slots (123) are thus present in the second surface forming the ground plane (140).

Figure 3:
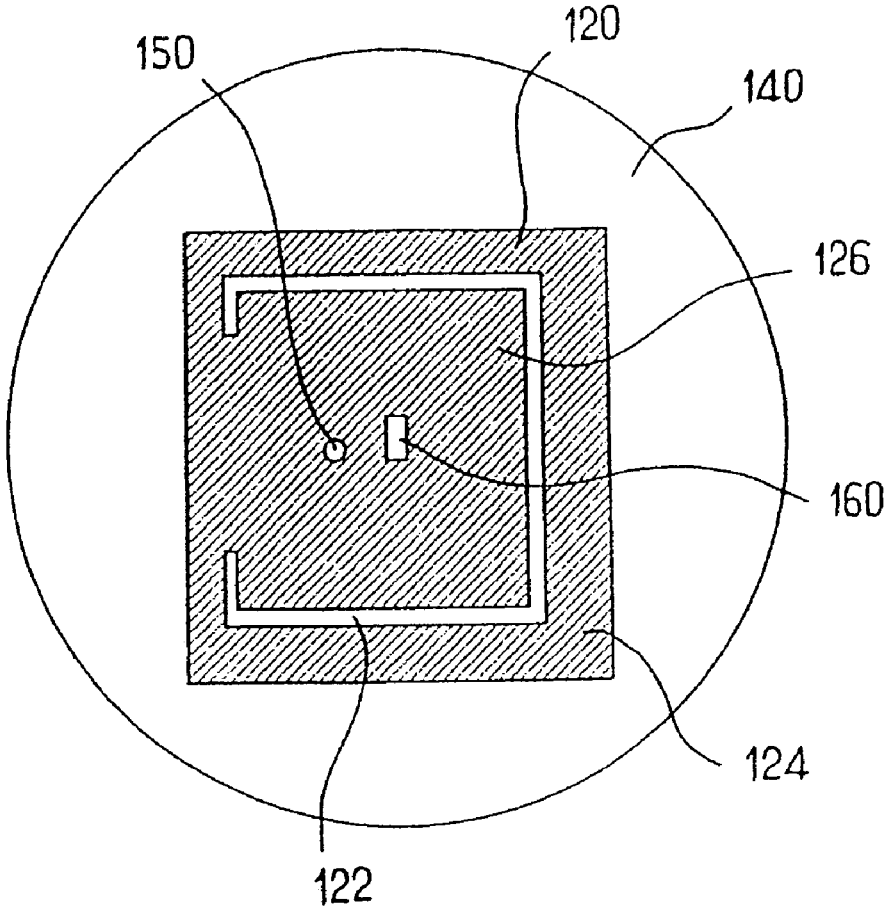
FIG. 3 is a view from above of an antenna according to a second embodiment of the invention.

In the embodiment of FIG. 3, the antenna has a disk-shaped ground plane 140 of diameter $\lambda/3$ where $\lambda$ corresponds to the wavelength that would be obtained with a same antenna but whose top part would be solid. A square-shaped upper plate forms the capacitive top part 120. This top part has a total width of $\lambda/6$. The cutout-slot 122 fully runs along three of the sides of this square, and extends from its ends at the fourth side by a short portion each time.

This second antenna with resonant cutout-slot also has a C-shape cutout-slot, this C being in this case perfectly symmetrical with respect to a plane that is transverse and median to the square top part. This C-shaped cutout-slot has a total length of around $\lambda_f/2$.

The cutout-slot 122 runs along the edges of the capacitive top part 120 maintaining a constant distance from the edges. Thus, it defines a square internally and a strip 124 of constant width externally.

The ground wire 160 and the feed wire 150 are both placed substantially at the center of the inner square 126 in a plane of symmetry of the cutout-slot 122, transverse to the antenna.

Such an antenna has a resonance at the wavelength $\lambda$, and also has a resonance approximately at the wavelength $\lambda_f/2$ which is specifically due to the cutout-slot 122. The antenna therefore has two resonances.

The ground wire 160 and the feed wire 150 are in this case placed on a median plane forming a plane of symmetry of the cutout-slot 122 in order to maintain good symmetry in the diagram.

Figure 4:
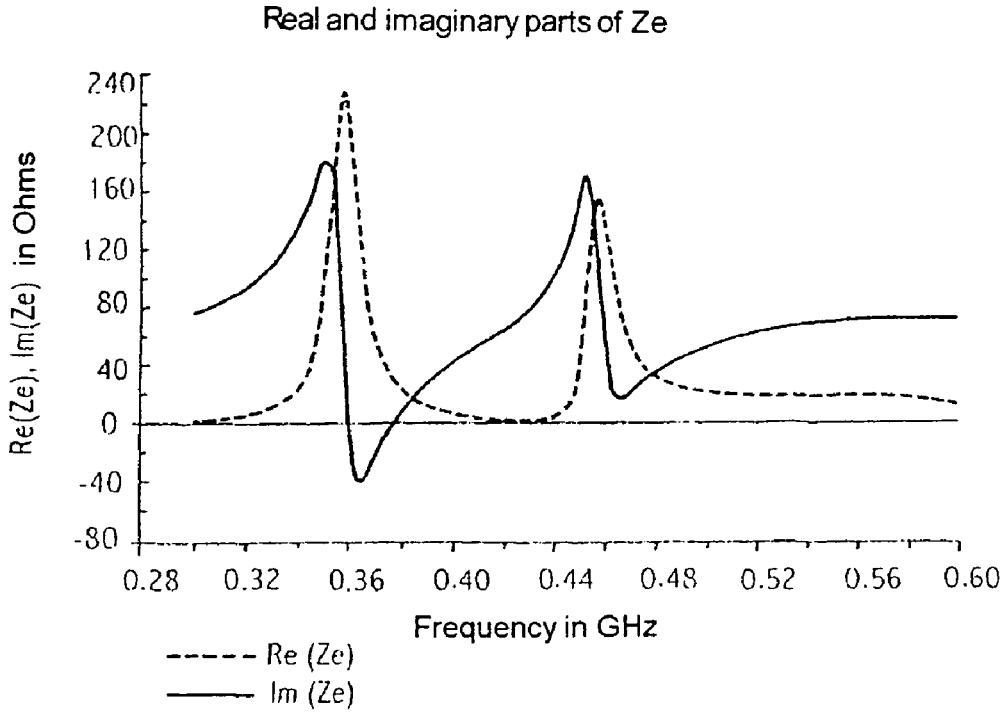
FIG. 4 represents the change, as a function of frequency, in the real part and imaginary part of an equivalent impedance of the antenna of FIG. 3.

As shown in FIG. 4, such an antenna has an equivalent impedance, each exhibiting two peaks at two frequencies.

More specifically, as represented in FIG. 4, both the real part and the imaginary part of the input impedance each have two peaks placed at these two frequencies respectively.

Figure 5:
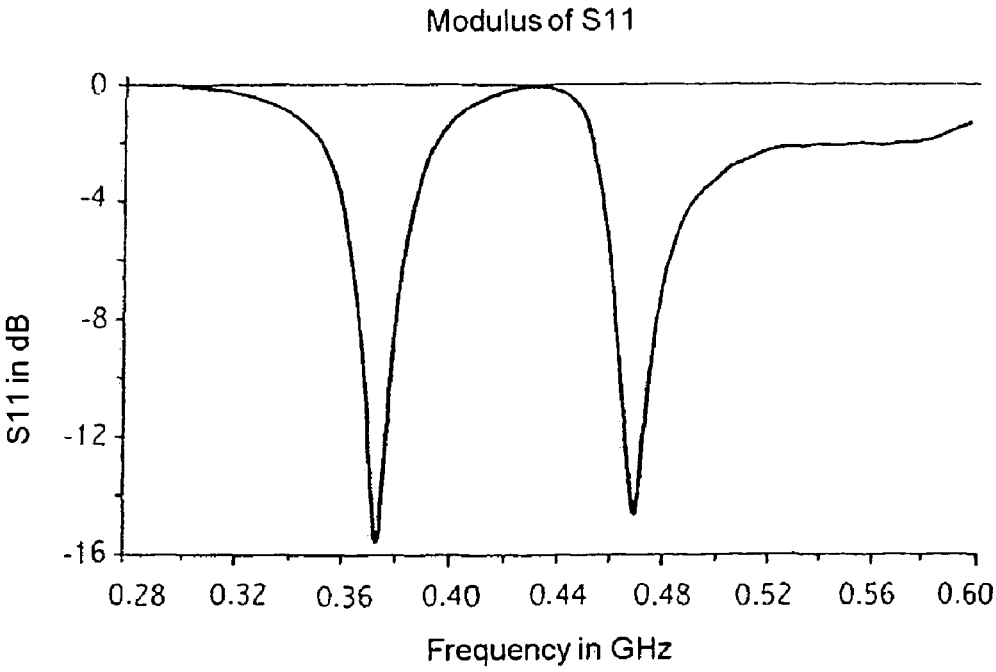
FIG. 5 represents the change, as a function of frequency, of a coefficient of reflection of the antenna of FIG. 3 in which two regions of matching can be counted.
Figure 6:
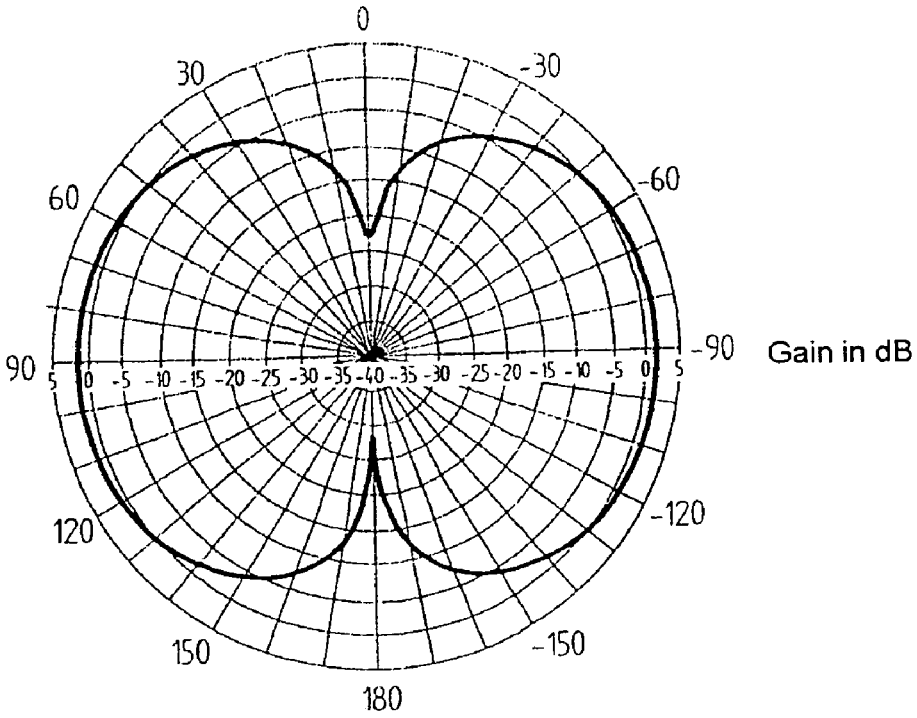
FIG. 6 is an elevation radiation pattern at a first resonant frequency of the antenna of FIG. 3.
Figure 7:
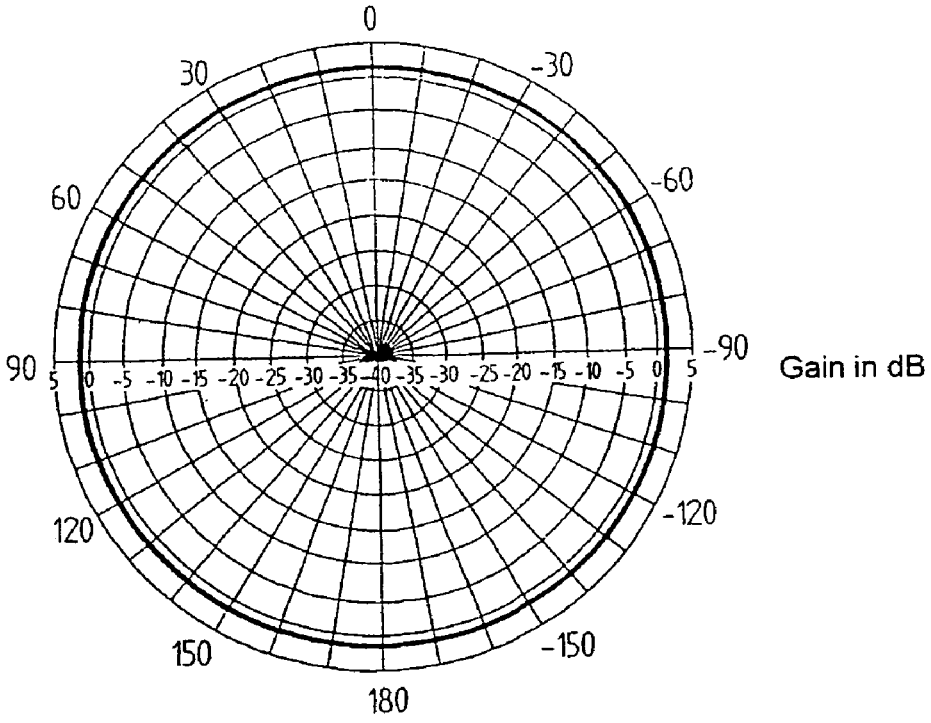
FIG. 7 is an azimuth radiation pattern at a first resonant frequency of the antenna of FIG. 3.
Figure 8:
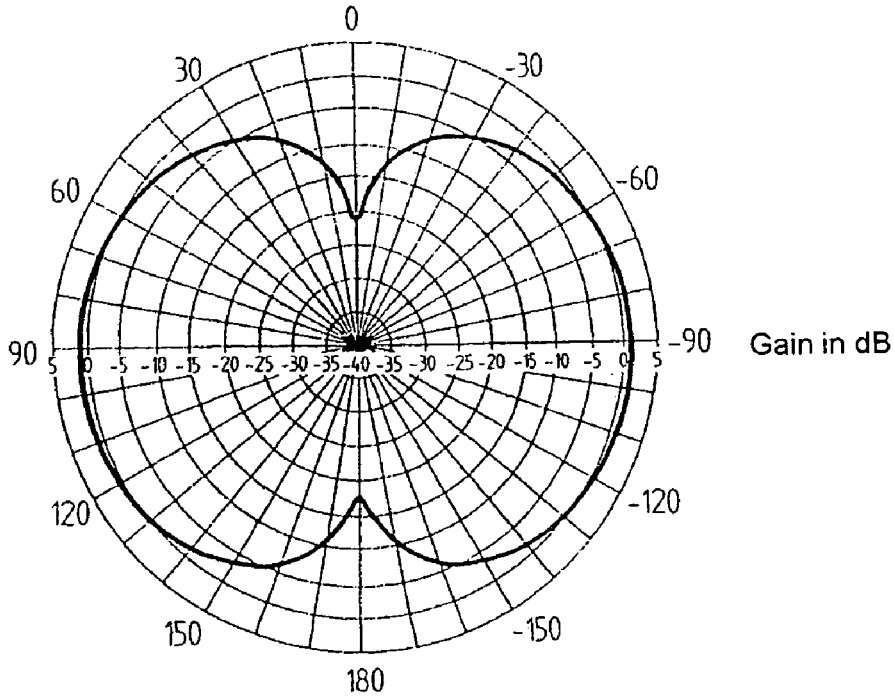
FIG. 8 is an elevation radiation pattern at a second resonant frequency of the antenna of FIG. 3.
Figure 9:
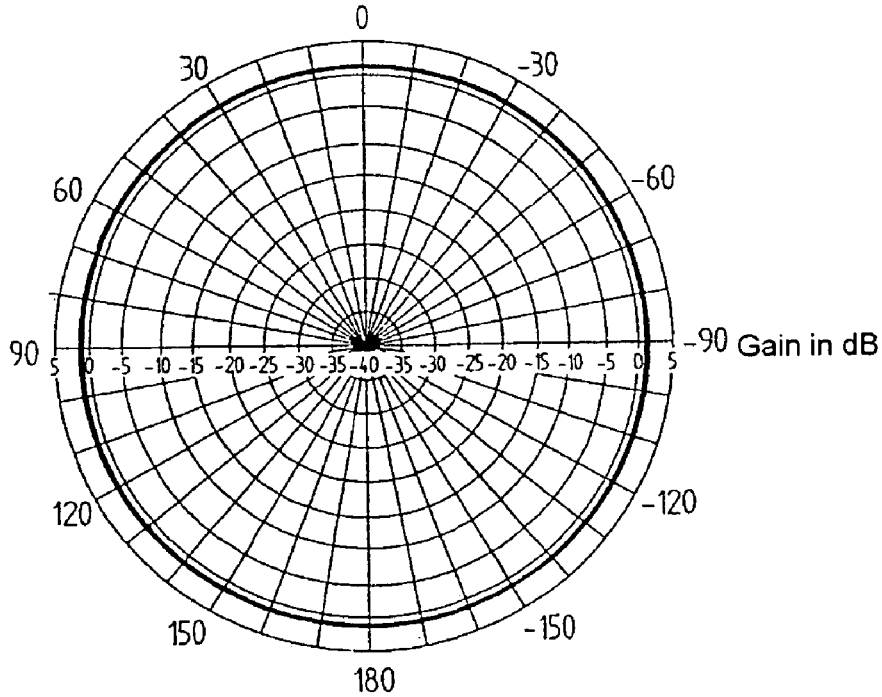
FIG. 9 is an azimuth radiation pattern at a second resonant frequency of the antenna of FIG. 3.

As illustrated in FIG. 5, the antenna has a reflection coefficient that also describes two peaks at these two same frequencies. The antenna has a good reflection coefficient, of about −16 dB, at these two frequencies. It is therefore dual band.

As illustrated in FIGS. 6 to 9, the antenna with cutout-slot, in FIG. 3, does indeed have a monopolar radiation pattern at each of the two resonances. The maximum value of the gain is about 1.7 dB.

A slight dissymmetry is observed on the elevation radiation pattern of the second resonance, and this is due to the dissymmetry of the slot with respect to an axis that is orthogonal to the wires 150 and 160 (more specifically with respect to a plane that is perpendicular to the plane of the wires, perpendicular to the antenna and median to the square formed by the upper plate 120).

Such a dissymmetry may be corrected for example by adopting, in place of the previously proposed cutout-slot 122 one or more pairs of cutout-slots.

Figure 10:
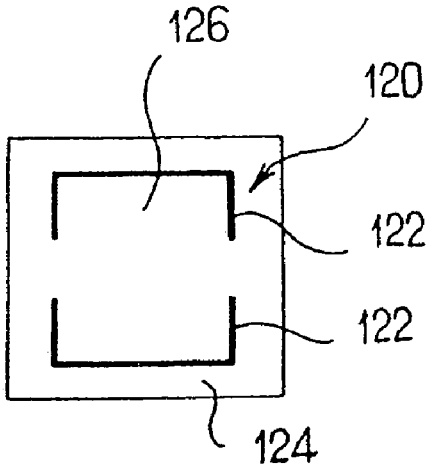
FIG. 10 is a view from above of a capacitive top part of an antenna according to a third embodiment of the invention.

Thus, FIG. 10 shows an upper plate 120 forming a capacitive top part and having two slots 122, each in the shape of a C, and open one facing the other. These two C-shapes facing each other define in this case too an inner capacitive region 126 that is surrounded by both of them almost completely. They also define an outer strip 124 of constant width.

Each of these C-shaped cutout-slots is formed by three rectilinear branches, each parallel with a side of the square formed by the plate 120. Thus, the two cutout-slots 122 are perfectly symmetrical one with the other, each also being symmetrical with respect to itself such that an upper plate 120 is obtained that is physically symmetrical with respect to two planes that are transverse and median to the square.

The feed wire 150 and the return wire 160 can be placed in one of these median planes and an electrical behavior can be obtained that is symmetrical with respect to the plane of these two wires.

In other words, cutting out on the top part 120 two cutout-slots 122 of the same dimensions results in making the radiation pattern symmetrical while maintaining two operating frequency bands.

A first operating band corresponds appreciably to the wavelength $\lambda$ of an antenna the capacitive top part of which would be formed by the inner region 126 enclosed by the cutout-slots 122, and the other operating frequency corresponds to a resonance close to $\lambda_f/2$ (half the abovementioned frequency) due to the cutout-slots 122 of same dimensions.

According to one variant, two (or more) cutout-slots are adopted having similar but not equal dimensions and/or having similar but not equal positionings. In this variant, two (or more) resonance peaks are obtained in addition to the wire-plate resonance. These two peaks are close to each other but not equal and they partially overlap, thereby generating in practice a widened frequency band that is additional to the effective operating frequency of the inner region 126.

According to yet another variant, two or more cutout-slots are adopted that extend one with respect to the other and that have dimensions that are sufficiently different to obtain two or more clearly different resonances which are additional with respect to the wire-plate resonance.

Radiation patterns similar to those of known antennas are obtained, but several different frequency bands.

The purpose of the cutout-slots is to create several overlapped wire-plate antennas, each wire-plate antenna formed substantially of the regions bounded by the cutout-slot and of the ground return, collective or otherwise, of the antenna.

The cutout-slots do not change the mode of radiation of each wire-plate antenna considered, which mode remains omnidirectional in azimuth since the slots are not sites for electromagnetic resonance at the frequencies considered.

The various antennas described previously have similar polarizations at their various resonant frequencies.

The various antennas proposed here supply, in addition to the advantages of the conventional wire-plate antenna, the advantage of exhibiting one or more new resonances, while being of a similar size to known antennas.

These antennas can be used to produce, for example, a matched aerial; they advantageously form multi-band antennas (for example for transmission and reception), for example with peaks that are close together in frequency, or even widened band antennas by having peaks that are sufficiently tightly close to one another.

These antennas enable the use of several frequency bands for mobile telephony, for example: GSM, DCS, DECT, or for use inside buildings (indoor use).

The various frequency bands obtained can be used for uplink or downlink paths, for example for transmission and reception in ARGOS tags. Such antennas can also be used for AMPS-PCS 1900 applications.

The invention claimed is:

1. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed ofmutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein said at least one second electrically-conductive wire or strip connecting the first and second surfaces makes contact with the first surface inside the inner region.

2. The antenna in claim 1, wherein the cutout-slot of the first surface has very small widths compared to its length and the operating wavelengths.

3. The antenna in claim 1, wherein said at least one second electrically-conductive wire or strip connecting the first and second surfaces makes contact with the first surface inside the inner region in the middle of the antenna.

4. The antenna in claim 1, wherein said first electrically-conductive feed wire or strip connecting a first terminal of a generator/receiver to the first surface makes contact with this first surface inside the inner region.

5. The antenna in claim 1, wherein the first and second surfaces are arranged one facing the other and in parallel with each other, the first and second electrically-conductive wires or strips extending one parallel with the other and perpendicularly to the planes of the two surfaces, and the cutout-slot forms two designs that are perfectly symmetrical with respect to a geometric plane passing through these two conductive wires or strips.

6. The antenna in claim 1, wherein the first surface has a cutout-slot formed of two sections each having the shape of a C, the open parts of which face each other.

7. The antenna in claim 6, wherein the two sections are symmetrical with each other with respect to a first geometric plane passing between these two sections and each section is symmetrical with itself with respect to a second geometric plane passing through the centers of the two sections.

8. The antenna in claim 1, wherein the first surface has at least two cutout-slots each having respective shapes that are sufficiently similar such that these two cutout-slots generate two peaks of electromagnetic effectiveness on the wire-plate mode, mixed at the same frequency.

9. The antenna in claim 1, wherein the first surface has at least two cutout-slots and these two cutout-slots have respective shapes that are sufficiently similar such that the two cutout-slots generate two peaks of electromagnetic effectiveness on the wire-plate mode, which overlap in the frequency, thus forming a widened effective operating frequency band.

10. The antenna in claim 1, wherein the first surface has at least two cutout-slots having sufficiently different shapes such that these cutout-slots generate at least two effective operating frequency regions, on the wire-plate mode, of the antenna which do not overlap one another.

11. The antenna in claim 1, wherein the first surface is defined by any type of shape, and the cutout-slot remains parallel to the edge of shape.

12. The antenna in claim 1, wherein one of the surfaces forming the ground plane includes at least one cutout slot of the same type as for the first surface.

13. The antenna in claim 12, wherein the first and second surfaces are substantially identical such that the cutout-slots are thus present in the second surface forming the ground plane.

14. The antenna in claim 12, wherein the second surface is markedly larger than the first surface.

15. The antenna in claim 1, wherein it includes one or more dielectric or magnetic layers between the surface forming the ground plane and the first surface and also above the two surfaces (radome).

16. The antenna in claim 1, wherein it comprises superposed top parts and intermediate planes, the cutout-slots being made in any intermediate plane, and dielectric or magnetic materials being interposed for rigidity or tunability.

17. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed of mutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein said first electrically-conductive feed wire or strip connecting a first terminal of a generator/receiver to the first surface makes contact with the first surface inside the inner region.

18. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed of mutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein the first and second surfaces are arranged facing one another and in parallel with each other, the first and second electrically-conductive wires or strips extending one parallel with the other and perpendicular to the planes of the two surfaces, and the cutout-slot forming two designs that are symmetrical with respect to a geometric plane passing through these two conductive wires or strips.

19. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed of mutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein the first surface has a cutout-slot formed of two C-shaped sections, the open parts of which face each other.

20. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed of mutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein the first surface has at least two cutout-slots, each having respective shapes that are sufficiently similar such that these two cutout-slots generate two peaks of electromagnetic effectiveness on the wire-plate mode, mixed at the same frequency.

21. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed of mutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein the first surface has at least two cutout-slots and these two cutout-slots have respective shapes that are sufficiently similar such that these two cutout-slots generate two electromagnetic effective-operation peaks effectiveness on the wire-plate mode, which overlap in the frequency, thus forming a widened effective operating frequency band.

22. A wire-plate antenna comprising:

a first electrically-conductive surface;

a second electrically-conductive surface, forming a ground plane, parallel to the first surface;

a first electrically-conductive feed wire or strip connecting a first terminal of a generator/receiver to the first surface;

the second surface being connected to a second terminal of the generator/receiver; and at least one second electrically-conductive wire or strip connecting the two abovementioned surfaces, wherein the first surface includes a cutout-slot formed of mutually extending sections, the cutout-slot stretching near and along an edge part of the first surface, the edge part being sufficiently extensive such that the cutout-slot defines an inner region of the first surface by forming most of the boundary of the inner region, thereby achieving a multi-frequency operation, wherein one of the surfaces forming the ground plane includes a cutout-slot of the same type as the first surface.

* * * * *